United States Patent [19]

Isaac et al.

[11] 3,941,388

[45] Mar. 2, 1976

[54] GAME AND NEWSPAPER SUPPLEMENT

[75] Inventors: Theodore N. Isaac; Nancy Ingles, both of Shawnee Mission, Kans.

[73] Assignee: Consumers Communication Corporation, Shawnee Mission, Kans.

[22] Filed: Oct. 7, 1974

[21] Appl. No.: 512,737

[52] U.S. Cl. ..... 273/134 G; 273/134 C; 273/134 E; 273/141 R

[51] Int. Cl.[2] ..... A63F 3/00

[58] Field of Search ..... 273/134, 137 R, 141 R, 273/142 R

[56] References Cited

UNITED STATES PATENTS

| | | | |
|---|---|---|---|
| 1,307,871 | 6/1919 | Miller | 273/137 R UX |
| 3,100,642 | 8/1963 | Goldstein | 273/134 CH |
| 3,199,231 | 8/1965 | Ruderian | 273/142 R X |

OTHER PUBLICATIONS

*Washington (D.C.) Sunday Star*, "This Week Sunday Supplement," Dec. 30, 1956, pp. 8, 9, 14.

*Primary Examiner*—Anton O. Oechsle
*Attorney, Agent, or Firm*—Fishburn, Gold & Litman

[57] ABSTRACT

A supplement sheet for insertion into a newspaper, magazine, or the like and having removable product coupons and a game portion with one or more removable card playing pieces. The game sheet includes indicia defining a game path with a multiplicity of adjoining segments, grid, ladder or the like. The game sheet also includes playing pieces which are separated from the sheet and movable along a defined game path, grid, ladder or other playing surface. One or more cards or chips may be separated from the sheet with each card having thereon instructions for movement of playing pieces and references to products of the various coupons. A number of game positions or movements are selected by operation of a chance selector or indicator which is assembled from parts which are an integral part of the sheet or by random selection of printed chips or cards. Preselected positions along the game path or within the grid have playing instructions, some of which refer to the coupons and/or cards which in turn can have further playing instructions thereon. The game is such as to attract the attention of a consumer to the coupons and the products which they advertise and also provide amusement for the players.

1 Claim, 3 Drawing Figures

GAME AND NEWSPAPER SUPPLEMENT

This invention relates to a supplement sheet for enclosing in a newspaper, magazine or the like with the supplement sheet having a game portion and advertising or value coupons attached thereto. Playing pieces and/or movement indicators are a part of the sheet and are used to move along a defined game path grid, ladder or the like for play by one or more players. The sheet is such as to attract attention to the coupons and the products which they advertise and keep that attention for a period of time while also amusing the players. In the past, advertising insert sheets have been used but have not had continued interest or been retained in the home to increase retention of interest in the minds of attracted consumers of the particular products or services being advertised.

The principal objects of the present invention are: to provide an advertising supplement sheet having advertising on front and back faces or some portions thereof and one or more advertising or value coupons removably attached to a game portion; to provide such on a sheet which attracts the attention of consumers and provides them with a game to play in connection with the coupons to attract their attention to the products advertised; to provide such a sheet which has all the necessary parts for playing the game as an integral part thereof with the sheet being adapted to be inserted into a newspaper, magazine, or the like; to provide separation indications or perforations between the coupons, playing pieces and cards and the game portion of the sheet so they can be easily separated for play and the coupons separately redeemed; to provide such a sheet with indicia defining a game path, grid or other playing surface having a plurality of game spots or adjoining segments therealong with certain of the game spots and cards having game playing instructions thereon, some of which refer to certain of the coupons and/or products or advertisers; to provide such a sheet with coupons which have playing instructions thereon which refer back to the defined game path and movement of the playing pieces; and to provide such a sheet which is simple in construction and well adapted for its intended purpose.

Other objects and advantages of the present invention will become apparent from the following description taken in connection with the accompanying drawings wherein are set forth by way of illustration and example certain embodiments of the present invention.

Figure 1:
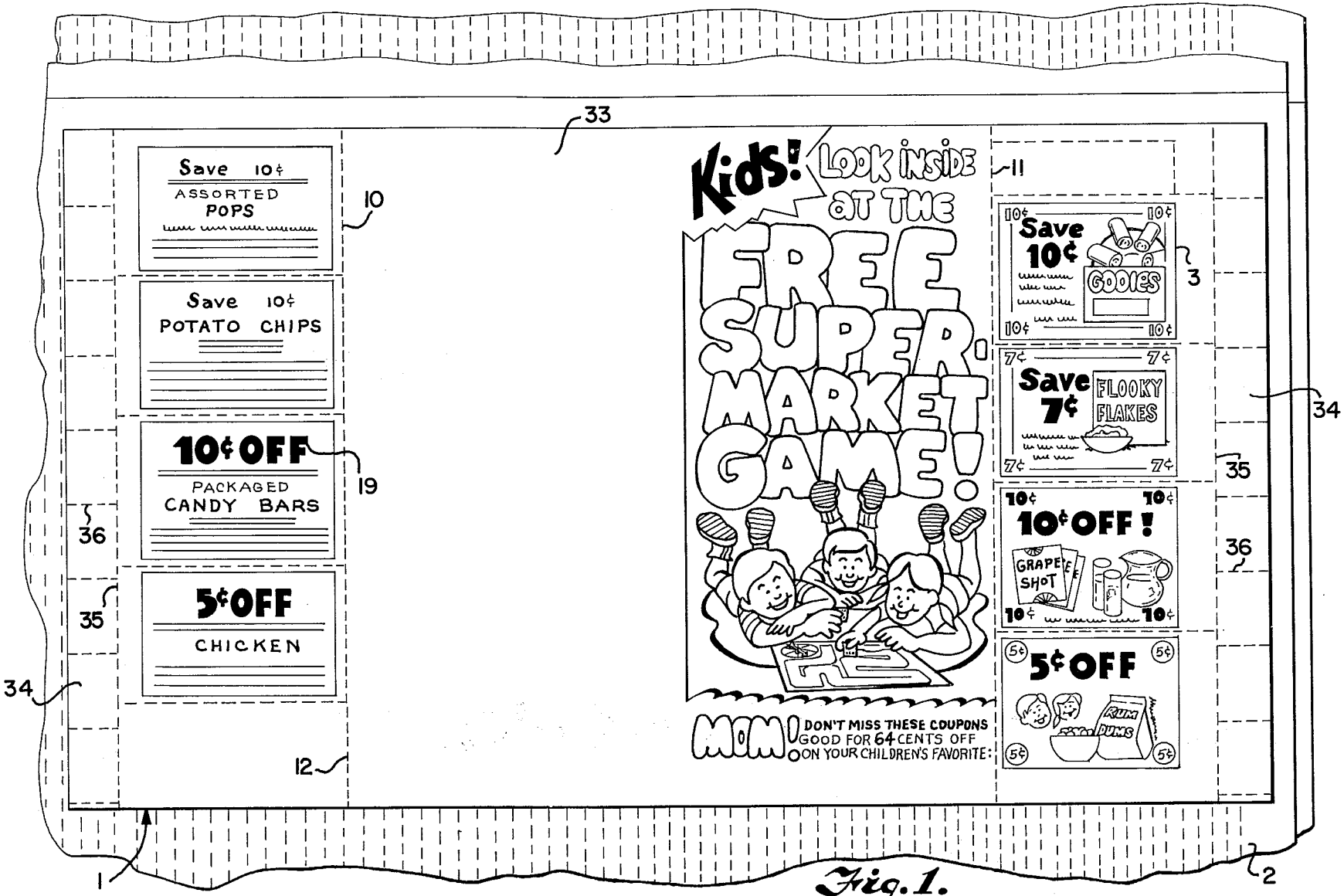
FIG. 1 is a plan view of an advertising insert shown in position in a newspaper for distribution.
Figure 2:
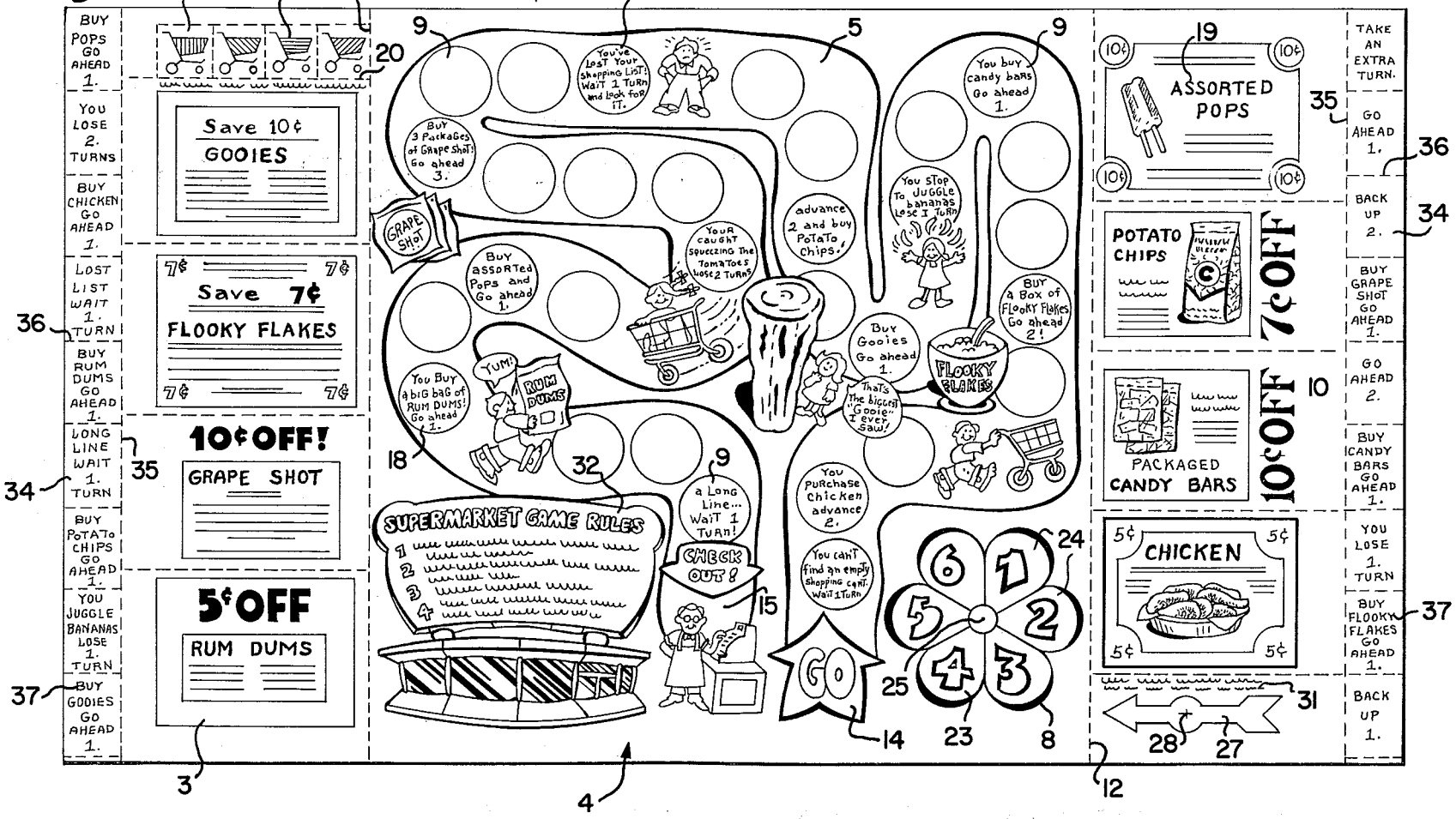
FIG. 2 is a plan view of the backside of the sheet showing same with playing pieces, cards and with an assembled indicator thereon.
Figure 3:
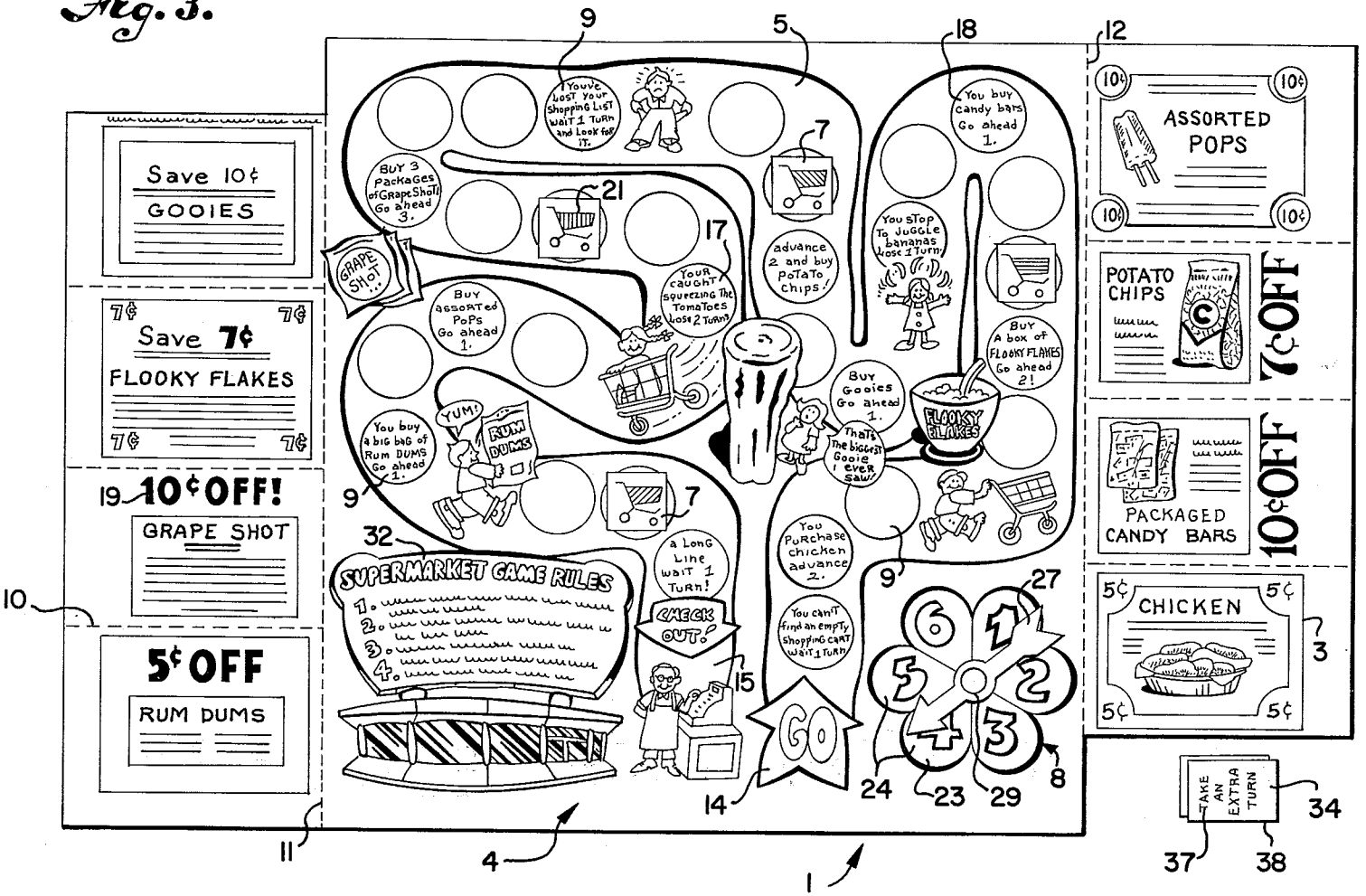
FIG. 3 is a plan view of the insert sheet showing same with playing pieces, cards and with an assembled indicator thereon Referring more in detail to the drawings.

As required, detailed embodiments of the present invention are disclosed herein, however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriate detailed structure.

The reference numeral 1 designates generally an advertising insert sheet adapted to be inserted between the pages of a magazine, newspaper 2 or the like, for distribution therewith. The sheet 1 has advertising coupons 3 thereon and has a game portion 4 also thereon with the game portion having a defined game path grid, ladder or other playing surface 5 printed thereon. Playing pieces 7 are also on the sheet 1, as is a movement selector means 8 which is operative for selecting the number of game spaces 9 to be moved by each playing piece 7 along the game path.

In the illustrated structure the sheet 1 is of a heavy paper such as paper stock of adequate rigidity and durability such as paper of a weight of 50 pounds or greater. The coupons 3 preferably are integral with the sheet 1 with indications such as weakened lines 10 therebetween so as to facilitate detachment of the coupon from the sheet 1 for redeeming same. Preferably the coupons 3 are positioned adjacent to edges 11 and 12 of the game portion. In the form shown, the coupons 3 have advertising indicia thereon and can also have playing instructions as later described. Preferably, the coupons 3 are positioned along edges of the game portion 4 and can be of any desired number.

The game portion 4 as described above has a defined game path grid, ladder or other playing surface 5 printed thereon with a plurality of game spots 9 positioned therealong. The game path playing surface commences as at 14 and terminates as at 15. Certain of the game spots have indicia providing instructions such as game spots 17 referring to movement or non-movement along the playing surface 5 and certain of the game spots, such as game spots 18, have indicia thereon which make reference to the coupons 3 wherein the coupons 3 can be game prizes or the coupons 3 can have indicia 19 printed thereon providing further playing instructions.

The playing pieces 7 are preferably an integral part of the sheet 1 and may be separated therefrom such as by having same defined by indications or perforated lines or can be cut as indicated by the lines 20. The playing pieces 7 have symbols 21 such as grocery carts thereon with each of the symbols preferably being a different color so as to identify the different playing pieces for each player.

The game selector means 8 can be of any suitable type and in the illustrated structure includes an area 23 preferably integral with and imprinted on the game portion 4 with the area 23 having a plurality of circumferentially spaced numbers as for example the numbers one through six each indicating a separate area 24 with the area 23 having a center point 25. As shown, an indicator 27 is preferably an integral part of the sheet 1 and is separable therefrom such as by cutting or having perforated lines defining same with the indicator as shown being in the form of an arrow. A center point 28 is marked on the indicator 27 and is adapted to have a pin 29 inserted therethrough and into the center point 25 whereby the indicator 27 can be positioned above the area 23 and rotated about the pin 29 to select the number of game spots to be moved. Indicia 31 is printed on the sheet 1 adjacent the indicator 27 providing instructions on separating and mounting same above the area 23. Rotation of the indicator 27 about the pin 29 by each of the players will select the number of game spots 5 to be advanced by playing pieces 7 by where the indicator stops.

Game rules are printed on the game portion 4 as at 32 and provide playing instructions for the players. The reverse side 33 of the sheet 1 has indicia printed thereon to attract the attention of a possible consumer and also has a reverse side of the coupons 3 imprinted thereon.

Game chips or cards 34 may be a part of the sheet 1 and separable therefrom and from each other along lines of separation 35 and 36 respectively. It is preferred that the line of separation 35 and 36 be indications, perforated, partially cut or otherwise weakened to facilitate separation. The cards 34 have indicia 37 on a face thereof that references to the brands advertised and shown on the coupons and directions for movement or some activity toward winning the game. The cards 34 may be used in place of the movement selector 8 or in conjunction therewith for determining the various moves of the players' playing pieces. The directions on each card 34 differs and preferably are used as when a playing piece moves to a particular point in the path the player draws a card which will permit a move ahead a few points or spots in the name of the advertiser or coupon item. In the illustrated structure the cards 34 are arranged along outer end edges of the coupons 3 with the lines 35 dividing same, however, it is to be understood the cards or additional cards may be arranged along the other edges of sheet 1.

The present invention is more fully understood by a description of the operation thereof. The sheet 1 is adapted to be inserted between the pages of a newspaper, magazine or the like and can be printed in attention attracting colors to further attract the attention of consumers and players. The indicator 27 is separated from the sheet 1 and rotatably mounted above the area 23 as described above. The playing pieces 7 are also separated from the sheet 1 with each of the players receiving a respective playing piece. The cards 34 are separated from the sheet 1 and from each other and arranged in a stack 38. Actuation of the chance selector or indicator 27 determines the number of game spots to be moved by each player and the first player to reach the termination 15 of the game playing surface 5 is a winner of the game. The game spots 17 provide playing instructions by either advancing a playing piece ahead or moving same back or other suitable game instructions can be provided. The game spots 18 refer to respective coupons 3 and according to the particular game rules the coupons can be either prizes or can make reference back to the game playing surface 5 providing further game instructions or both. Also certain spots may call for drawing a card which in turn will make further or additional reference to the advertisers and products and give movement instructions. It is to be noted that such a sheet provides both an amusing game and increases the interest and attention of a consumer and player in the products advertised on the coupons 3.

It is to be understood that while we have illustrated and described certain forms of our invention, it is not to be limited to the specific form or arrangement of parts herein described and shown.

What we claim and desire to secure by Letters Patent is:

1. A combined advertising insert and game with redeemable coupons for insertion as an advertising supplement between parts of a newspaper and the like comprising:

a. a generally rectangular sheet of paper having side and end edges;

b. said sheet having first and second lines spaced apart and spaced from and parallel to respective end edges of said sheet, said sheet having a plurality of spaced third lines extending between said first and second lines and between the respective end edge and the adjacent first and second lines and defining a plurality of separable coupons and a plurality of separable cards and a plurality of separable playing pieces;

c. said first, second and third lines on the sheet are lines of weakness for facilitating separation of the coupons, cards and playing pieces from the sheet and from each other;

d. said coupons having indicia thereon referring to different products to represent same in the game and indicia referring to terms for redemption of said coupons;

e. said cards having various indicia thereon referring to products indentified on the different coupons and giving directions for movement of the playing pieces;

f. said sheet having imprinted thereon a game area and indicia defining a game path divided into successive game spots positioned therealong and indicia referring to products identified on the coupons and giving playing pieces moving directions;

g. said coupons are positioned adjacent the game area and the cards and playing pieces are between the coupons and a respective end edge of the sheet whereby the coupons may remain attached after removal of the cards and playing pieces, said coupons remaining attached serve as identification and association with product indicia on the game area until removed for redemption;

h. said playing pieces when separated being movable from game spot to game spot along said path;

i. a plurality of numbers on said sheet in a circle about a center point, said numbers being circumferentially spaced apart; and j. an indicator integral with said sheet and separable therefrom for rotatable mounting above said sheet adjacent said numbers wherein the number indicated by the indicator after rotation is the number of game spots to be moved by a said playing piece along said game path.

* * * * *